United States Patent [19]

Divelbiss et al.

[11] 4,284,110

[45] Aug. 18, 1981

[54] APPARATUS FOR TRANSFER OF FLUENT MATERIALS FROM ONE CONTAINER TO ANOTHER

[75] Inventors: Carl D. Divelbiss, Roslyn, Wash.; Mortimer R. Dock, Arlington, Va.

[73] Assignee: Frances K. Divelbiss, Roslyn, Wash.

[21] Appl. No.: 59,743

[22] Filed: Jul. 23, 1979

Related U.S. Application Data

[63] Continuation-in-part of Ser. No. 806,908, Jun. 15, 1977, abandoned.

[51] Int. Cl.[3] ..... B65B 3/04; B63C 7/16

[52] U.S. Cl. ..... 141/98; 114/50; 141/311 R; 141/387; 141/DIG. 1

[58] Field of Search ..... 114/50; 141/1, 98, 231, 141/279, 311 R, 329, 387, 388, 392, DIG. 1

[56] References Cited

U.S. PATENT DOCUMENTS

| | | | |
|---|---|---|---|
| 3,822,660 | 7/1974 | Throner | 114/50 |
| 3,890,796 | 6/1975 | Kruger | 114/50 X |

*Primary Examiner*—Frederick R. Schmidt

[57] ABSTRACT

Apparatus for transferring fluent material such as a liquid or gas from a chamber in which it is contained into a receiving chamber, at least one of said chambers having rigid metallic walls and being inaccessible for the use of conventional transfer means, said two chambers being connected by means such as a hose extending between one of said chambers and a hollow body sealedly attached onto the wall of the other chamber, and means for creating an orifice in the wall of said other chamber to permit the passage of a liquid or gas therethrough; pumping means to activate such transfer; and other means for the retrieval of said apparatus.

12 Claims, 5 Drawing Figures

APPARATUS FOR TRANSFER OF FLUENT MATERIALS FROM ONE CONTAINER TO ANOTHER

This application is a continuation-in-part of co-pending application Ser. No. 806,908, filed June 15, 1977, now abandoned.

The present invention relates to apparatus for injecting a fluent material such as a liquid or gas into a rigid metallic container, or extracting such fluent material therefrom, where conventional fittings or equipment normally employed to perform such injection or extraction are not operational or where one of said containers is so located that the point of use is inaccessible.

This apparatus may be used, for example, for the recovery of oil from sunken or capsized ships or barges, or for providing air to humans trapped in metal containers such as ships, barges, etc., or for rapid removal of fuel from burning storage tanks, and extraction of fluid from tanks where usual processes have been disabled or are inoperable. For purposes of clarity and simplicity, the procedures for operation of this equipment will be directed to the first of said uses, namely, the retrieval of oil from sunken or capsized ships or barges. Such description, however, is intended to be illustrative rather than to limit the uses for this equipment.

The invention comprises a hollow body connected at one end to a hose, said body having therein a motor driven by any conventional means, and said body being herein referred to as the housing. Integrally connected to said motor there is a shaft connected at the end opposite the power source to a circular cutting saw.

Mounted on the exterior of the housing there are provided at least two outwardly extending legs having magnetic feet attached to the legs by spring or other force mechanism which will provide sufficient pressure of the apparatus on the rigid container to enable the cutting saw to create an orifice in the wall of the rigid chamber.

Hose means are used to connect the housing to a surface vessel (to continue the example under discussion) into which oil is drawn upon its extraction from a sunken or capsized vessel. Conventional pumping equipment is employed in effecting such transfer.

The motor disposed in the housing may be electric or hydraulic, or air driven, or power may be derived from any other suitable or available means.

The power lines for operating the motor may be accommodated either inside or outside the material transfer hose.

The apparatus is lowered from the surface vessel by means such as cables, so that the rate of descent may be governed, and is positioned by divers upon the wall of a rigid metallic container, such as the hull of a ship or the wall of an oil tank susceptible of magnetic attraction, with the cutter teeth of the circular saw abutting said hull or wall. The magnetic feet are then emplaced on the hull, thus securing the circular saw in position for cutting. A pilot drill may be centrally disposed within the circular saw, to perforate the steel plate of the hull of the ship or the wall of the tank, thus serving to retain the saw in desired position.

With secure contact established by the magnetic feet, the motor is activated to operate first the pilot drill and then the cutter to create the desired orifice. When the cutting is complete, the circular piece of steel falls into the tank and the cutter end of the housing follows the circular saw into the orifice, being driven thereinto by the force mechanism associated with the legs and the magnetic feet.

In the use herein described, i.e., the recovery of oil from a submerged vessel, it is possible that some water may enter the tank while the circular saw is in operation and during the insertion of the end of the housing. In that event, the water sinks to the bottom of the tank, leaving the oil readily accessible to the suction force of the pump on the recovery vessel.

When the cutter end of the housing is fully inserted into the orifice, an annular gasket and flange encircling the housing are brought into abutment with the outer surface of the steel plate forming the wall of the submerged chamber, thus sealing the equipment against further entry of water. The thickness and compressibility of the gasket permits adjustment to curvature, if any, in the surface of the steel plate forming the wall.

The holding power of the magnetic feet is then reinforced by locking dogs, attached to a power ram contained within the housing, said power ram having the capability of both forward and reverse operation, thus permitting release of the dogs to allow retrieval of the apparatus. The dogs are actuated in the lock direction when a sensor on the annular flange comes into contact with the rigid surface of the wall of the submerged vessel, and are caused to lock upon the periphery of the orifice. The equipment is then ready for actuation of the pumping apparatus for removal of the contents of the submerged vessel (in the example herein under discussion) or for injection of a liquid or gas in such other uses as may require the transfer of a liquid or gas from one container to another. The pumping apparatus constitutes a reversible pump, being suited for either extraction or injection of material.

For a better understanding of this invention, reference may be had to the accompanying drawings, wherein.

Figure 1:
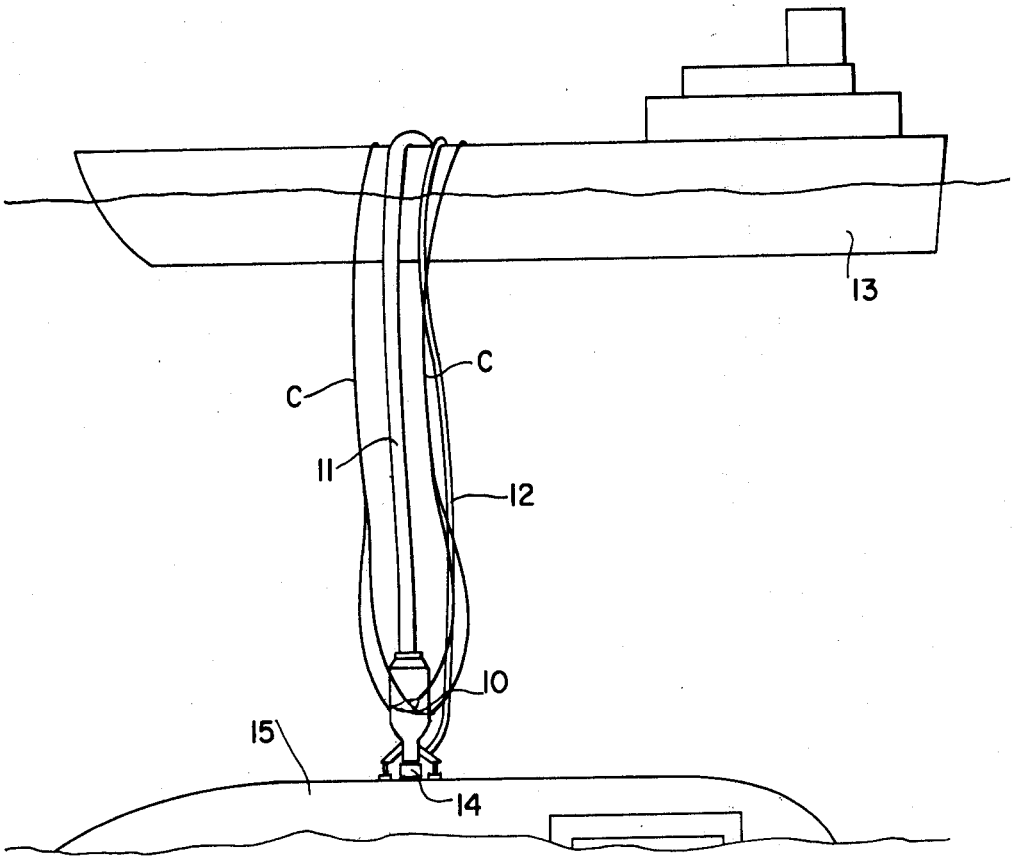
FIG. 1 is a perspective view showing this invention connected between a surface vessel and a second body, submerged in water.

Referring more particularly to the drawings:

FIG. 1 is a perspective view of the housing 10 of this invention, connected by hose 11 and power line 12 to surface vessel 13, and cutting saw 14 attached upon the wall of a rigid container 15, such as the hull of a submerged ship or barge.

Figure 2:
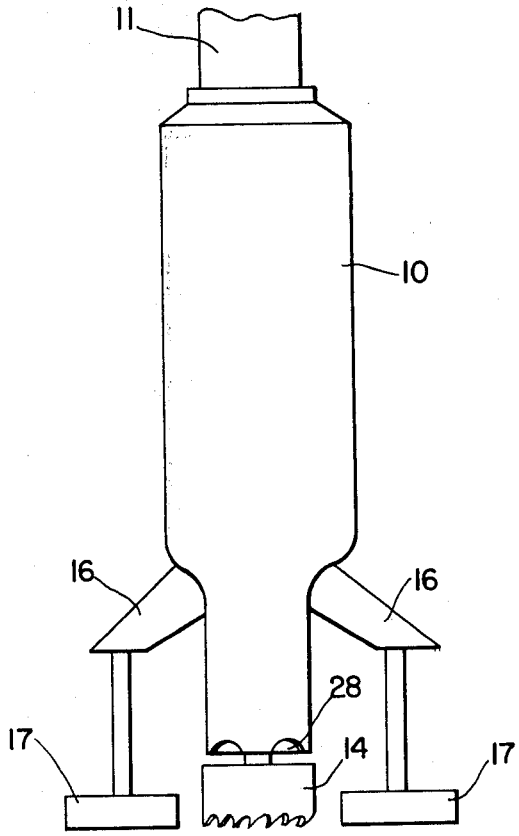
FIG. 2 is a side elevation showing the integral structure of the housing, with outwardly extending legs and magnetic feet, and a connecting hose at one end of the housing and a cutting saw at the opposite end thereof.

In FIG. 2, housing 10 is shown with outwardly extending legs 16, each leg having a magnetic foot 17 at the end thereof to hold the apparatus in position for operation of the circular saw 14.

Figure 3:
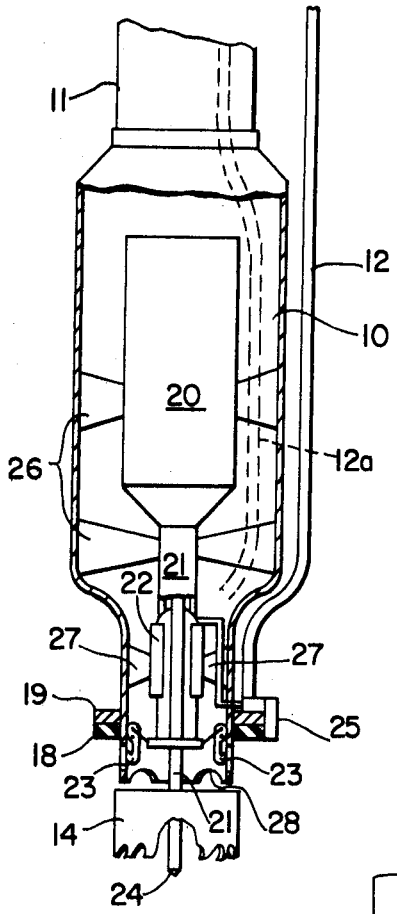
FIG. 3 is a view of the housing of FIG. 2 with the wall cut away to show the structure of the mechanism contained therewithin.

In FIG. 3, an annular gasket 18 and annular flange 19 encircling the forward end of the housing 10 are provided to effect secure sealing of the equipment upon the hull of the submerged ship 15 (see FIG. 5) and motor 20 is shown accommodated within housing 10, with power line 12 leading to the surface vessel. Alternatively, and indicated by dotted lines in the drawing, the said power line, indicated by number 12*a* may be disposed inside the housing 10 and the hose 11, thus simplifying the connecting line from the housing 10 to the receiving container, i.e., the surface vessel 13.

Power shaft 21 forms an integral connection between the motor 20 and the power ram 22. At the forward end of power ram 22 there are dogs 23 hingedly disposed within the mouth of the housing 10. Surrounding the housing and spaced back from the mouth thereof, there are seen annular gasket 18 and annular flange 19. The power shaft 21 terminates at its connection with circular saw 14 in a pilot drill 24, which is centrally disposed within circular saw 14 to facilitate positioning of the saw.

Figure 4:
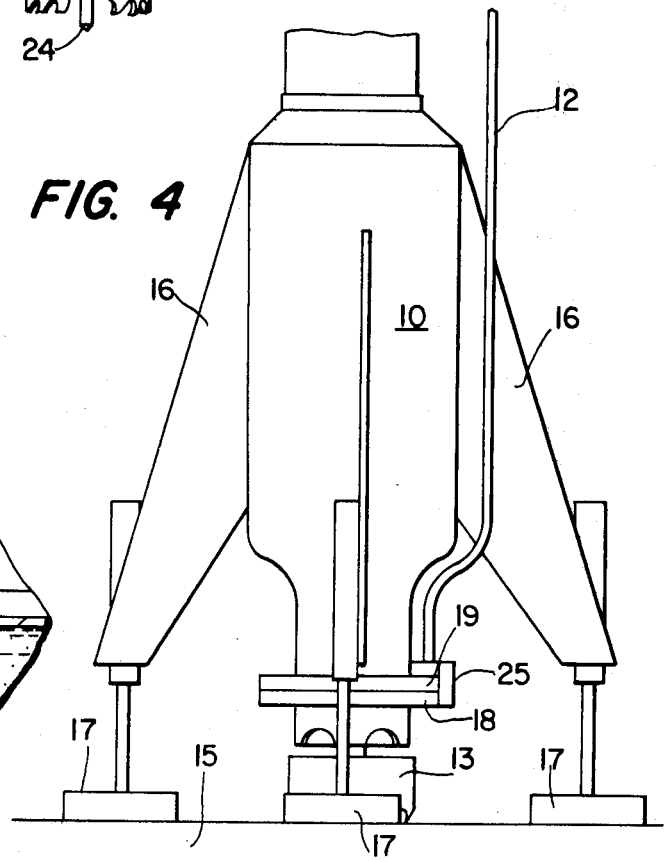
FIG. 4 shows a side elevation of the housing, with the magnetic feet disposed upon the wall of the rigid container.

In FIG. 4, there is shown a side view of this apparatus, wherein legs 16 with attached magnetic feet 17 are attached to the exterior of the housing 10. When the leading end of the apparatus is brought into contact with the hull of the submerged vessel or the wall of the tank (rigid body 15), the magnetic feet 17 are attracted to the steel plate and serve to secure the apparatus during the process of cutting an orifice in the steel plate.

Figure 5:
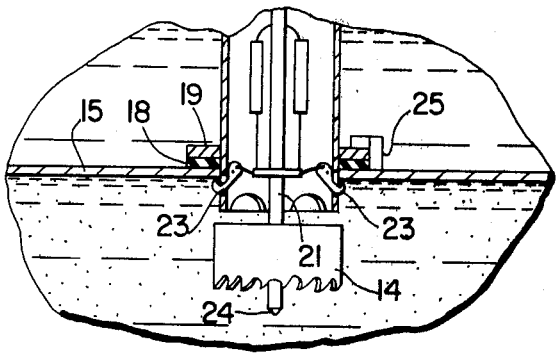
FIG. 5 is a detail showing the locking dogs in position to hold the housing securely in place.

Locking dogs 23, seen in FIG. 5, are actuated by a sensor 25 attached to flange 19, when the flange and the gasket 18 meet with the resistance of the rigid body 15. Upon such actuation, the dogs are forced out of the mouth of the housing and each dog rotates outwardly so that the hook portion thereof engages the edge of the orifice.

The motor and drill apparatus herein described are conventional equipment, commercially available. Such equipment is made, for example, by T. D. Williamson, Inc., and is sold under the trade name "WmSon-Hillco Tapping Machine" . When sealed within the housing, this apparatus may be operated by remote control.

When employed, as in the example disclosed herein, for the recovery of oil from a sunken barge or oil tanker, the apparatus is lowered by supporting cables C (see FIG. 1) from a retrieval vessel, with the housing connected by hose means to said vessel, and is emplaced by divers upon the hull of the submerged barge or tanker. Upon contact of the magnetic feet with the steel plate forming the hull, the pilot drill is activated to establish a position for operation of the circular cutting saw. When the circular saw has created an orifice in the steel plate, the leading tip of the housing 10 follows the saw through the orifice and sensor 25 on flange 19 actuates the dogs 23, as hereinabove described.

The motor 19 is supported upon the interior of the housing by brackets 26, seen in FIG. 3, and the power ram 22 is supported in like manner by brackets 27. Since the motor may be sealed to prevent damage upon its immersion in a liquid, and the power ram and dogs are fully operable in such immersion, oil from the submerged vessel may be pumped through the housing and hose 11 into a receiving chamber in vessel 13. The pumping apparatus is conventional, and may be reversed for either extraction or injection of the material desired to be transferred.

Cut-outs 28 in the leading end of the housing, adjacent the circular saw, are provided to permit passage of fluent materials into and through the housing, in the event the plate cut from the wall of the tank, or, in the example under discussion, the hull of the sunken vessel, becomes lodged in the saw instead of falling to the bottom of the tank.

Following completion of the extraction process, the sensor 25 reverses the locking action of the dogs 23 to release their hold upon the periphery of the orifice. When the support cables C which have sustained the apparatus upon its removal from the surface vessel are tightened for retrieval of the apparatus, the lifting power of the cables exceeds the attraction of the magnetic feet to the steel hull of the sunken vessel, and the apparatus may then be drawn to the surface and hauled aboard the recovery ship. Thus the product of this invention serves not only to recover the contents of a sunken ship or barge, but the apparatus itself, being heavy and costly, may also be retrieved and moved to other locations for use in additional recoveries.

Having thus disclosed our invention, we claim:

1. An apparatus detachably securable upon the surface of a container for the transfer of the fluid or aeriform contents thereof to a receiving vessel, said apparatus comprising a housing having upon the exterior thereof at least two projecting legs having magnetic feet for initial engagement of said apparatus with said container; and disposed within said housing a motor connected by power lines and hose means extending between said apparatus and said receiving vessel, and integrally connected to said motor a power shaft and a power ram; locking dogs hingedly connected to said power ram for the detachable securement of said apparatus to said container; a pilot drill centrally disposed within a circular saw integrally connected to said power ram, said saw projecting beyond the end of said housing most distant from said motor and being adapted to cut an orifice in the wall of said container; and sealing gasket and ring means for preventing the escape of the contents of said container; said entire apparatus being retrievable after removal of said contents from said container by release of the locking action of said dogs.

2. The invention of claim 1 wherein said magnetic feet are adapted for magnetic attraction to and adherence upon the surface of said container, for retention of said apparatus pending mechanical locking of said dogs.

3. The invention of claim 1 wherein said motor and said power lines are adapted to draw upon and transmit power from a source such as for an electric, hydraulic or air-driven motor.

4. The invention of claim 3 wherein said power means, said locking dogs and said pilot drill and circular saw, are remotely operated through said power lines by activation of said power source.

5. The invention of claim 1 wherein said hose means accommodates the passage of fluid or aeriform materials to or from said container.

6. The invention of claim 1 wherein said pilot drill defines and holds a point of contact with said container, whereby said saw is operated to cut an orifice in the wall of said container, the portion thus cut from said wall being permitted to drop into said container, leaving said orifice open to permit entry of the forward end of said housing and to engage with the locking dogs of said apparatus.

7. The invention of claim 6 whereby, upon said entry and said engagement, the contents of said container are drawn therefrom, into and through said housing and thence through said hose means into said receiving vessel.

8. The invention of claim 1 wherein said sealing gasket and ring means, being circumferentially disposed upon the leading end of said housing, are spaced a distance from the end thereof sufficient to permit entry of said end into said orifice and the sealing of the juncture of said housing and said orifice, thus preventing the escape of any part of the contents of said container.

9. The invention of claim 1 wherein said dogs are activated to engage points on the periphery of said orifice, thus detachably locking said apparatus upon said container for extraction of the contents thereof.

10. The invention of claim 1 wherein said power ram is activated to release the locking action of said dogs, thus permitting retrieval of said apparatus upon completion of extraction of the contents of said container.

11. The invention of claim 1 wherein said hose means are operated to inject fluent material such as a liquid or a gas into said container, or to extract the same therefrom.

12. The invention of claim 1 wherein said apparatus is supported by means such as cables to govern the rate of its movement from the said receiving vessel, to sustain its emplacement upon the surface of said container, and to return it to the receiving vessel upon completion of the transfer process.

* * * * *